US011038274B2

(12) United States Patent
Kim et al.

(10) Patent No.: US 11,038,274 B2
(45) Date of Patent: Jun. 15, 2021

(54) ANTENNA APPARATUS AND ANTENNA MODULE

(71) Applicant: Samsung Electro-Mechanics Co., Ltd., Suwon-si (KR)

(72) Inventors: Nam Ki Kim, Suwon-si (KR); Jeong Ki Ryoo, Suwon-si (KR)

(73) Assignee: Samsung Electro-Mechanics Co., Ltd., Suwon-si (KR)

( * ) Notice: Subject to any disclaimer, the term of this patent is extended or adjusted under 35 U.S.C. 154(b) by 174 days.

(21) Appl. No.: 16/176,015

(22) Filed: Oct. 31, 2018

(65) Prior Publication Data

US 2019/0229426 A1 Jul. 25, 2019

(30) Foreign Application Priority Data

Jan. 23, 2018 (KR) ..... 10-2018-0008358
May 11, 2018 (KR) ..... 10-2018-0054152

(51) Int. Cl.

| | |
|---|---|
| ***H01Q 9/28*** | (2006.01) |
| ***H01Q 9/20*** | (2006.01) |
| ***H01Q 1/48*** | (2006.01) |
| ***H01Q 21/06*** | (2006.01) |
| ***H01Q 1/24*** | (2006.01) |

(Continued)

(52) U.S. Cl.

CPC ..... *H01Q 9/20* (2013.01); *H01Q 1/243* (2013.01); *H01Q 1/48* (2013.01); *H01Q 1/521* (2013.01); *H01Q 21/065* (2013.01); *H01Q 21/08* (2013.01)

(58) Field of Classification Search

CPC ..... H01Q 1/243; H01Q 1/24; H01Q 1/48; H01Q 21/06; H01Q 21/065; H01Q 9/20; H01Q 9/28; H01Q 9/285; H01Q 1/38; H01Q 1/52; H01Q 1/521; H01Q 21/08; H01Q 9/04; H01Q 9/045

See application file for complete search history.

(56) References Cited

U.S. PATENT DOCUMENTS 5,229,782 A * 7/1993 Hemmie ..... H01Q 9/285 343/795
5,532,708 A * 7/1996 Krenz ..... H01Q 9/285 343/795

(Continued)

FOREIGN PATENT DOCUMENTS

JP 5417389 B2 2/2014
KR 10-1195047 B1 10/2012

(Continued)

OTHER PUBLICATIONS

Korean Office Action dated Feb. 20, 2019 in corresponding Korean Patent Application No. 10-2018-0054152 (5 pages in English, 5 pages in Korean).

*Primary Examiner* — Tho G Phan
(74) *Attorney, Agent, or Firm* — NSIP Law

(57) ABSTRACT

An antenna apparatus includes a ground layer, a wiring layer spaced apart from either a first surface or a second surface of the ground layer and including wiring lines, feed lines electrically connected to the wiring lines, a dipole antenna pattern to transmit and/or receive an RF signal, a plurality of feed vias to electrically connect poles of the dipole antenna pattern to the feed lines, and a ground pattern to electrically connect the poles of the dipole antenna pattern to the ground layer.

13 Claims, 15 Drawing Sheets

(51) Int. Cl.
*H01Q 21/08* (2006.01)
*H01Q 1/52* (2006.01)

(56) References Cited

U.S. PATENT DOCUMENTS

| | | | | |
|---|---|---|---|---|
| 5,771,024 | A * | 6/1998 | Reece | H01Q 1/38 343/725 |
| 5,917,456 | A | 6/1999 | Teunisse | |
| 6,275,192 | B1 * | 8/2001 | Kim | H01Q 1/38 343/700 MS |
| 9,570,809 | B2 | 2/2017 | Ganchrow et al. | |
| 2002/0084942 | A1 * | 7/2002 | Tsai | H01Q 9/285 343/795 |
| 2013/0016029 | A1 | 1/2013 | Tsutsumi | |
| 2016/0294052 | A1 | 10/2016 | Baek et al. | |

FOREIGN PATENT DOCUMENTS

| | | | |
|---|---|---|---|
| KR | 10-2013-0080776 | A | 7/2013 |
| KR | 10-2013-0141680 | A | 12/2013 |
| KR | 10-2015-0130046 | A | 11/2015 |
| WO | WO 2011/149941 | A1 | 12/2011 |
| WO | WO 2012/129426 | A2 | 9/2012 |

* cited by examiner

ANTENNA APPARATUS AND ANTENNA MODULE

CROSS-REFERENCE TO RELATED APPLICATIONS

This application claims the benefit under 35 USC 119(a) of Korean Patent Application No. 10-2018-0008358 filed on Jan. 23, 2018 and Korean Patent Application No. 10-2018-0054152 filed on May 11, 2018 in the Korean Intellectual Property Office, the entire disclosures of which are incorporated herein by reference for all purposes.

BACKGROUND

1. Field

The following description relates to an antenna apparatus and an antenna module.

2. Description of Related Art

Data traffic of mobile communications is increasing rapidly every year. Technological development is underway to support the transmission of such rapidly increased data in real time in wireless networks. For example, the contents of internet of things (IoT) based data, augmented reality (AR), virtual reality (VR), live VR/AR combined with SNS, autonomous navigation, applications such as Sync View (real-time video transmissions of users using ultra-small cameras), and the like may require communications (e.g., 5G communications, mmWave communications, etc.) supporting the transmission and reception of large amounts of data.

Recently, millimeter wave (mmWave) communications, including 5th generation (5G) communications, have been researched, and research into the commercialization/standardization of an antenna module for smoothly realizing such communications is progressing.

Since radio frequency (RF) signals in high frequency bands (e.g., 24 GHz, 28 GHz, 36 GHz, 39 GHz, 60 GHz, etc.) are easily absorbed and lost in the course of the transmission thereof, the quality of communications may be dramatically reduced. Therefore, antennas for communications in high frequency bands may require different approaches from those of conventional antenna technology, and a separate approach may require further special technologies, such as separate power amplifiers for securing antenna gain, integrating an antenna and radio frequency integrated circuit (RFIC), and securing effective isotropic radiated power (EIRP), and the like.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, an antenna apparatus includes a ground layer, a wiring layer spaced apart from either a first surface or a second surface of the ground layer and including wiring lines, feed lines electrically connected to the wiring lines, a dipole antenna pattern to transmit and/or receive an RF signal, a plurality of feed vias to electrically connect poles of the dipole antenna pattern to the feed lines, and a ground pattern to electrically connect the poles of the dipole antenna pattern to the ground layer.

The ground pattern may extend from the ground layer to an area between the poles of the dipole antenna pattern and may overlap a space between two of the feed lines.

The plurality of feed vias may extend in a thickness direction of the antenna apparatus, the dipole antenna pattern may extend in a first direction perpendicular to the thickness direction, and the feed lines and the ground pattern may extend in a second direction perpendicular to the thickness direction and perpendicular to the first direction.

The antenna apparatus may include a director pattern coplanar with the dipole antenna pattern and spaced apart from the dipole antenna pattern in the second direction.

The antenna apparatus may include a second ground layer disposed between the ground layer and the wiring layer; and a second ground pattern electrically connected to the second ground layer and disposed between the feed lines and the ground pattern.

The second ground pattern may have a larger area than the ground pattern and may overlap at least a portion of the ground pattern and at least a portion of each of the feed lines in a direction perpendicular to a thickness direction of the antenna apparatus.

The antenna apparatus may include a third ground layer and a third ground pattern electrically connected to the third ground layer. The wiring layer may be disposed between the second ground layer and the third ground layer, and the feed lines may be disposed between the second ground pattern and the third ground pattern.

The wiring layer, the ground layer, and the second ground layer may have recessed regions in a direction opposite to a direction in which the dipole antenna pattern is spaced apart from the ground layer, and the third ground layer may overlap the recessed regions of the wiring layer, the ground layer, and the second ground layer in a direction perpendicular to a thickness direction of the antenna apparatus.

The antenna apparatus may include shield vias electrically connected to one or both of the ground layer and the second ground layer, and surrounding at least a portion of the recessed regions of the wiring layer, the ground layer, and the second ground layer in the direction perpendicular to the thickness direction.

In another general aspect, antenna module includes a connection member including a wiring layer and a ground layer, an integrated circuit (IC) disposed on a first side of the connection member and electrically connected to the connection member, patch antenna patterns disposed on a second side of the connection member, patch antenna feed vias electrically connecting the patch antenna patterns to the connection member, and dipole antenna patterns disposed on side surfaces of the connection member and electrically connected to corresponding wiring lines of the wiring layer, to receive and/or transmit an RF signal, and the dipole antenna patterns are electrically connected to each other.

The wiring layer may be electrically connected to the IC to transmit and/or receive an RF signal to/from the dipole antenna patterns and the patch antenna patterns, and the ground layer may be electrically connected to the IC to ground the IC.

The antenna module may include a passive component disposed on the first side of the connection member and electrically connected to the connection member, and the ground layer may be electrically connected to the passive component.

The antenna module may include a shield member disposed on the first side of the connection member to confine the IC together with the connection member, and the ground layer may be electrically connected to the shield member.

The antenna module may include a sub-substrate disposed in on the first side of the connection member and electrically connected to the connection member to receive an IF signal or a baseband signal from the outside and transmit the IF signal or the baseband signal to the IC, or to receive an IF signal or a baseband signal from the IC and transmit the IF signal or the baseband signal to the outside.

The antenna module may include a second ground layer disposed between the ground layer and the wiring layer, and the second ground layer may include protruded regions protruding toward the dipole antenna patterns in a direction perpendicular to a thickness direction of the antenna module.

The antenna module may include a third ground layer, the wiring layer may be disposed between the second ground layer and the third ground layer, and the third ground layer may include second protruded regions protruding toward the dipole antenna patterns in the direction perpendicular to the thickness direction.

In another general aspect, an apparatus includes an antenna. The antenna includes a dipole antenna pattern configured to transmit and/or receive an RF signal, a ground layer, a ground pattern extending from the ground layer to a dipole center of the dipole antenna pattern, a wiring layer spaced apart from the ground layer and including wiring lines, and feed lines extending from the wiring layer such that the ground pattern overlaps a space between the feed lines.

The apparatus may include a patch antenna pattern.

The apparatus may include a substrate, and the antenna and the patch antenna pattern may be disposed adjacent to a lateral boundary on the substrate.

The apparatus may include a communication module connected to the antenna.

Other features and aspects will be apparent from the following detailed description, the drawings, and the claims.

BRIEF DESCRIPTION OF DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

Figure 1A:
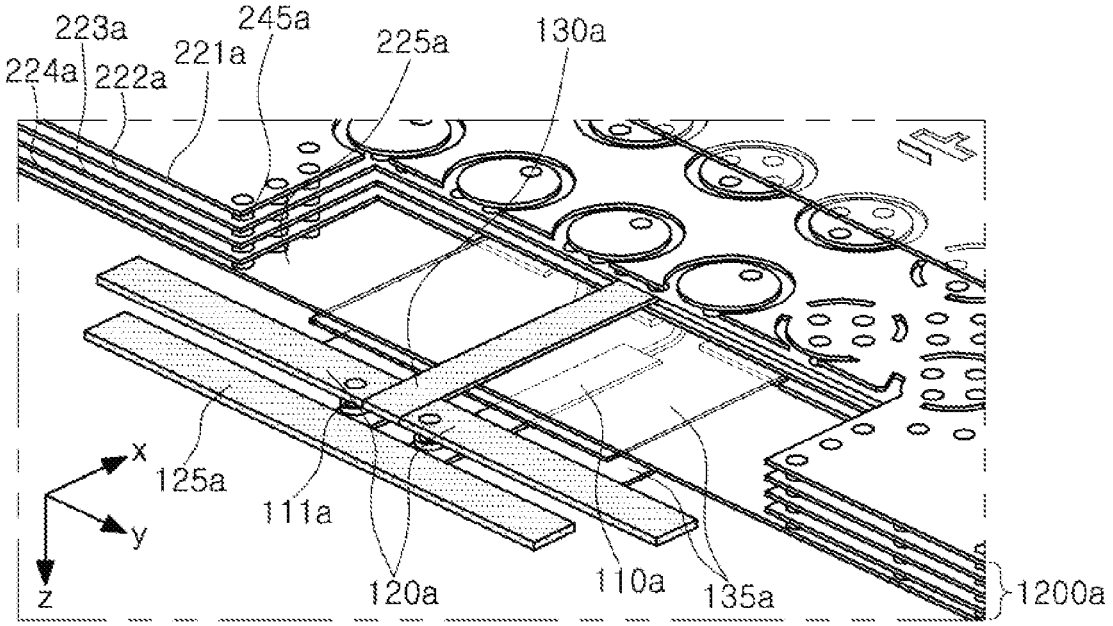
FIGS. 1A and 1B are perspective views illustrating an antenna apparatus according to an example.

The following detailed description is provided to assist the reader in gaining a comprehensive understanding of the methods, apparatuses, and/or systems described herein. However, various changes, modifications, and equivalents of the methods, apparatuses, and/or systems described herein will be apparent after an understanding of the disclosure of this application. For example, the sequences of operations described herein are merely examples, and are not limited to those set forth herein, but may be changed as will be apparent after an understanding of the disclosure of this application, with the exception of operations necessarily occurring in a certain order. Also, descriptions of features that are known in the art may be omitted for increased clarity and conciseness.

The features described herein may be embodied in different forms, and are not to be construed as being limited to the examples described herein. Rather, the examples described herein have been provided merely to illustrate some of the many possible ways of implementing the methods, apparatuses, and/or systems described herein that will be apparent after an understanding of the disclosure of this application.

Herein, it is noted that use of the term "may" with respect to an example or embodiment, e.g., as to what an example or embodiment may include or implement, means that at least one example or embodiment exists in which such a feature is included or implemented while all examples and embodiments are not limited thereto.

Throughout the specification, when an element, such as a layer, region, or substrate, is described as being "on," "connected to," or "coupled to" another element, it may be directly "on," "connected to," or "coupled to" the other element, or there may be one or more other elements intervening therebetween. In contrast, when an element is described as being "directly on," "directly connected to," or "directly coupled to" another element, there can be no other elements intervening therebetween.

As used herein, the term "and/or" includes any one and any combination of any two or more of the associated listed items.

Although terms such as "first," "second," and "third" may be used herein to describe various members, components, regions, layers, or sections, these members, components, regions, layers, or sections are not to be limited by these terms. Rather, these terms are only used to distinguish one member, component, region, layer, or section from another member, component, region, layer, or section. Thus, a first member, component, region, layer, or section referred to in examples described herein may also be referred to as a second member, component, region, layer, or section without departing from the teachings of the examples.

Spatially relative terms such as "above," "upper," "below," and "lower" may be used herein for ease of description to describe one element's relationship to another element as shown in the figures. Such spatially relative terms are intended to encompass different orientations of the device in use or operation in addition to the orientation depicted in the figures. For example, if the device in the figures is turned over, an element described as being "above" or "upper" relative to another element will then be "below" or "lower" relative to the other element. Thus, the term "above" encompasses both the above and below orientations depending on the spatial orientation of the device. The device may also be oriented in other ways (for example, rotated 90 degrees or at other orientations), and the spatially relative terms used herein are to be interpreted accordingly.

The terminology used herein is for describing various examples only, and is not to be used to limit the disclosure. The articles "a," "an," and "the" are intended to include the plural forms as well, unless the context clearly indicates otherwise. The terms "comprises," "includes," and "has" specify the presence of stated features, numbers, operations, members, elements, and/or combinations thereof, but do not preclude the presence or addition of one or more other features, numbers, operations, members, elements, and/or combinations thereof.

Due to manufacturing techniques and/or tolerances, variations of the shapes shown in the drawings may occur. Thus, the examples described herein are not limited to the specific shapes shown in the drawings, but include changes in shape that occur during manufacturing.

The features of the examples described herein may be combined in various ways as will be apparent after an understanding of the disclosure of this application. Further, although the examples described herein have a variety of configurations, other configurations are possible as will be apparent after an understanding of the disclosure of this application.

Figure 1B:
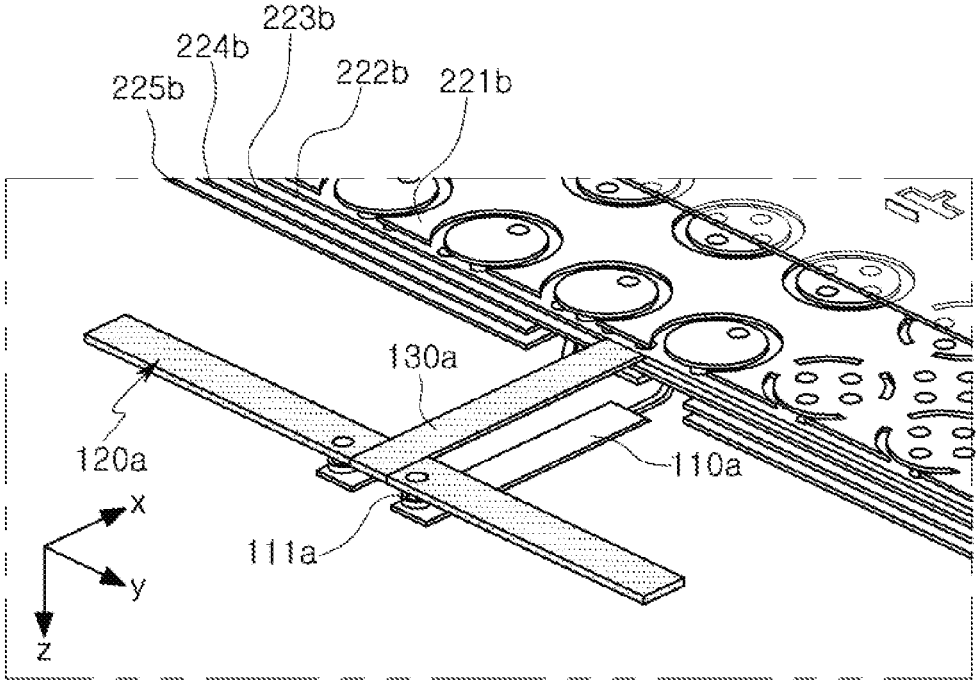
Figure 2A:
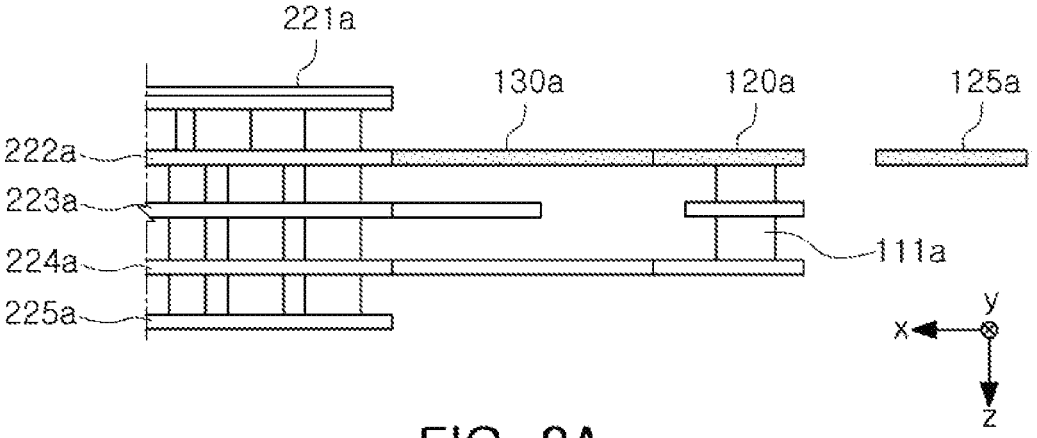
FIGS. 2A and 2B are side views illustrating an antenna apparatus according to an example.
Figure 2B:
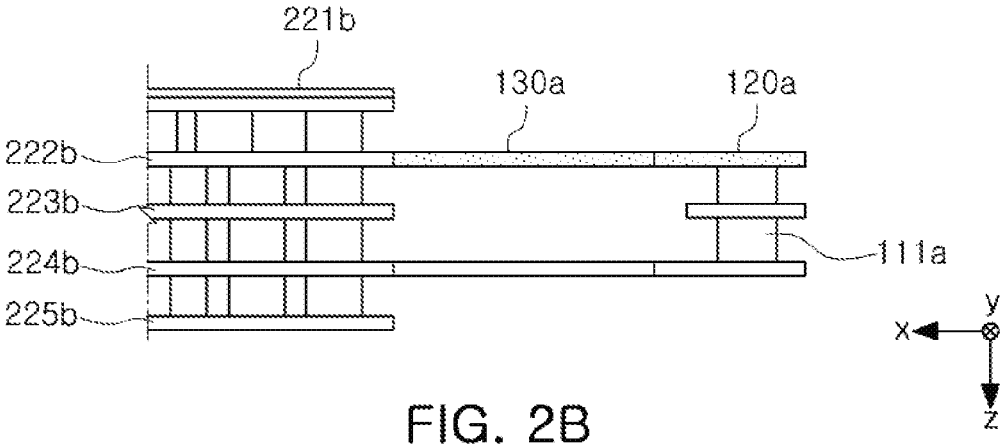

FIGS. 1A and 1B are perspective views illustrating an antenna apparatus according to an example, and FIGS. 2A and 2B are side views illustrating an antenna apparatus according to an example. In FIGS. 1A, 1B, 2A, and 2B, a Z direction indicates a direction toward an upper surface or a thickness direction of the antenna apparatus.

Referring to FIGS. 1A, 1B, 2A, and 2B, a connection member 1200*a* may include at least a portion of IC ground layers 221*a* and 221*b*, ground layers 222*a* and 222*b*, second ground layers 223*a* and 223*b*, wiring layers 224*a* and 224*b*, and third ground layers 225*a* and 225*b*, and may further include an insulating layer disposed between the plurality of layers.

In the IC ground layers 221*a* and 221*b* and the ground layers 222*a* and 222*b*, a ground used in circuitry of the IC and/or passive components may be provided as an IC and/or a passive component. The IC ground layers 221*a* and 221*b* and the ground layers 222*a* and 222*b* may be electrically connected to the IC and/or passive components. The IC ground layers 221*a* and 221*b* may be omitted, depending on the ground demand of the IC and/or the passive components.

The wiring layers 224*a* and 224*b* may be disposed to be spaced apart from and in a position higher or lower than a position of the ground layers 222*a* and 222*b*, and may include a wiring line through which a radio frequency (RF) signal flows, and a wiring ground pattern surrounding the wiring line. The wiring line may be electrically connected to the IC through a wiring via. A boundary of the wiring ground pattern may overlap a boundary of the IC ground layers 221*a* and 221*b*, a boundary of the ground layers 222*a* and 222*b*, and a boundary of the second ground layers 223*a* and 223*b*, when viewed in a vertical direction.

The wiring layers 224*a* and 224*b* may be disposed between the respective second ground layers 223*a* and 223*b* and third ground layers 225*a* and 225*b*. The second ground layers 223*a* and 223*b* may improve a degree of electromagnetic isolation between wiring lines of the wiring layers 224*a* and 224*b* and an IC, and may provide a ground with the IC and/or passive components. The third ground layers 225*a* and 225*b* may improve a degree of electromagnetic isolation between wiring lines of the wiring layers 224*a* and 224*b* and a patch antenna pattern, may provide a boundary condition in terms of the patch antenna pattern, and may reflect an RF signal transmitted and received by the patch antenna pattern to further concentrate a transmission/reception direction of the patch antenna pattern.

Referring to FIGS. 1A, 1B, 2A, and 2B, an antenna apparatus according to an example, may include a feed line 110*a*, a feed via 111*a*, a dipole antenna pattern 120*a*, a ground pattern 130*a*, ground layers 222*a* and 222*b*, and wiring layers 224*a* and 224*b*.

The feed line 110*a* may be electrically connected to the corresponding wiring of the wiring layers 224*a* and 224*b*, and may function as a transmission path of an RF signal. The feed line 110*a* may be viewed as a component included in the wiring layers 224*a* and 224*b* depending on the viewpoint. The dipole antenna pattern 120*a* may be disposed adjacent to a side surface of the connection member 1200*a*, such that the feed line 110*a* may have a structure extending from the corresponding wiring lines of the wiring layers 224*a* and 224*b* toward the side surface of the connection member 1200*a*.

The feed line 110*a* may include first and second feed lines. For example, the first feed line may be configured to transmit an RF signal to the dipole antenna pattern 120*a*, and the second feed line may be configured to receive an RF signal from the dipole antenna pattern 120*a*. For example, the first feed line may be configured to receive an RF signal from the dipole antenna pattern 120*a* or to transmit an RF signal to the dipole antenna pattern 120*a*, and the second feed line may be configured to provide impedance to the dipole antenna pattern 120*a*.

For example, the first and second feed lines may transmit an RF signal to the dipole antenna patterns 120*a* and receive an RF signal from the dipole antenna patterns 120*a*, respectively, and may be configured to have a phase difference from each other (e.g., 180 degrees, 90 degrees) in a differential feeding method. The phase difference may be realized by a phase shifter of the IC, or a difference in electrical length between the first and second feed lines.

The feed line 110*a* may include a ¼ wavelength converter or a balun to improve RF signal transmission efficiency, but the ¼ wavelength converter or the balun may also be omitted.

The feed via 111*a* may be disposed to electrically connect the dipole antenna pattern 120*a* and the feed line 110*a*. The feed via 111*a* may be disposed perpendicular to the dipole antenna pattern 120*a* and the feed line 110*a*.

Due to the feed via 111*a*, the dipole antenna pattern 120*a* may be disposed in a position higher or lower than a position of the feed line 110*a*. The specific position of the dipole antenna pattern 120*a* may vary, depending on a length of the feed via 111*a*. A radiation pattern direction of the dipole antenna pattern 120*a* may be slightly inclined in a vertical direction according to a length design of the feed via 111*a*.

The feed via 111*a* may be surrounded by an insulating layer. For example, the insulating layer may be disposed in a position higher and/or lower than a position of at least a portion of the feed line 110*a*, the dipole antenna pattern 120*a*, a director pattern 125*a*, and the ground pattern 130*a*.

The dipole antenna pattern 120*a* may be configured to be electrically connected to the feed line 110*a* to transmit or receive an RF signal. Ends of respective poles of the dipole antenna pattern 120*a* may be electrically connected to the first and second lines of the feed line 110*a*.

The dipole antenna pattern 120*a* may have a frequency band (for example, 28 GHz, 60 GHz) in accordance with at least one of a length of the pole, a thickness of the pole, an interval between the poles, a distance between the pole and the side surface of the connection member, and a dielectric constant of the insulating layer.

The dipole antenna pattern 120*a* and the ground pattern 130*a* may be viewed as components included in the ground layers 222*a* and 222*b*, depending on the viewpoint. For example, the ground layers 222*a* and 222*b* may connect respective poles of the dipole antenna pattern 120*a* to each other to electrically connect to a dipole antenna pattern of a neighboring antenna apparatus.

The ground pattern 130*a* may be disposed to electrically connect respective poles of the dipole antenna pattern 120*a* and the ground layers 222*a* and 222*b*. The dipole antenna pattern 120*a* may share a ground with a neighboring antenna apparatus that is electrically connected to the ground layers 222*a* and 222*b*, such that a degree of electromagnetic isolation for a neighboring antenna apparatus may be improved. This will be described later with reference to FIGS. 6A to 6C.

The ground pattern 130*a* may have a structure extending from between the respective poles of the dipole antenna pattern 120*a* to the ground layers 222*a* and 222*b*. A point at which a transmission direction of the RF signal flowing through the feed line 110*a* and the feed via 111*a* is angled may be adjacent to an area or a point between the respective poles of the dipole antenna pattern 120*a*. The point may act as an electromagnetic coupling source with regard to the director pattern 125*a* or a neighboring antenna apparatus. A degree of isolation of the dipole antenna pattern 120*a* with respect to a neighboring antenna apparatus may be further improved, as the point is closer to the ground pattern 130*a*. The ground pattern 130*a* may effectively improve a degree of isolation of the dipole antenna pattern 120*a* with respect to a neighboring antenna apparatus.

When a degree of isolation of the dipole antenna pattern 120*a* with respect to a neighboring antenna apparatus is reduced, a reference spacing distance between the dipole antenna pattern 120*a* and a neighboring antenna apparatus (e.g., 0.5 times a wavelength of an RF signal) may be further shortened.

An antenna apparatus according to the disclosure may reduce a limitation in the degree of freedom of design, due to an influence of other antenna apparatus, and thus may have an improved degree of freedom in designing the antenna apparatus. Further, antenna performance (e.g., transmission/reception ratio, gain, directivity, etc.) may be improved by utilizing the improved degree of freedom in designing the antenna apparatus. Since an antenna apparatus according to the disclosure may be more efficiently disposed on the antenna module, the size of the antenna apparatus and/or the antenna module may be relatively reduced.

The ground pattern 130*a* may have a structure extending from the respective poles of the dipole antenna pattern 120*a* to the ground layers 222*a* and 222*b*, to be located between the feed lines 110*a*, when viewed in a vertical direction. The ground pattern 130*a* may be symmetrical with respect to the feed line 110*a*.

An RF signal flowing through the feed line 110*a* and the feed via 111*a* may be symmetrically branched from the dipole antenna pattern 120*a*. The ground pattern 130*a* may greatly reduce negative impacts, which may affect the dipole antenna pattern 120*a*, as a degree of lateral symmetry increases. The ground pattern 130*a* may provide a ground with the dipole antenna pattern 120*a*, while relatively reducing an influence of the dipole antenna pattern 120*a* on antenna performance. For example, an antenna apparatus according to the disclosure may improve isolation performance with respect to a neighboring antenna apparatus without deteriorating the actual antenna performance, thereby improving the antenna performance.

Referring to FIGS. 1A and 2A, the antenna apparatus and antenna module may further include the director pattern 125*a* disposed at the same height (planar height) as the dipole antenna pattern 120*a*, and disposed to be spaced apart from the dipole antenna pattern 120*a* laterally.

The director pattern 125*a* may be electromagnetically coupled to the dipole antenna pattern 120*a* to improve gain or bandwidth of the dipole antenna pattern 120*a*. The director pattern 125*a* may have a length shorter than the total dipole length of the dipole antenna pattern 120*a*, and may improve concentration of the electromagnetic coupling of the dipole antenna pattern 120*a*, such that gain or directivity of the dipole antenna pattern 120*a* may be further improved.

Referring to FIGS. 1A and 2A, the antenna apparatus and antenna module may include second and third ground patterns 135*a* disposed to be spaced apart from the feed line 110*a* and in a position higher or lower than a position of the feed line 110*a*.

The second ground pattern among the second and third ground patterns 135*a* may be electrically connected to the second ground layer 223*a*, and may be viewed as a component included in the second ground layer 223*a*, depending on the viewpoint. For example, the second ground layer 223*a* may have a protruded region protruding toward the dipole antenna pattern 120*a*, when viewed in a vertical direction, and the protruded region may correspond to the second ground pattern.

The third ground pattern among the second and third ground patterns 135*a* may be electrically connected to the third ground layer 225*a*, and may be viewed as a component included in the third ground layer 225*a*, depending on the viewpoint. For example, the third ground layer 225*a* may have a second protruded region protruding toward the dipole antenna pattern 120*a*, when viewed in a vertical direction, and the second protruded region may correspond to the third ground pattern.

The second and third ground patterns 135*a* may be electromagnetically coupled to the dipole antenna pattern 120*a*, and may affect frequency characteristics of the dipole antenna pattern 120*a*, depending on a shape of the second and third ground patterns 135*a* (e.g., a width, a length, a distance to a feed line, a degree of electrical isolation to an antenna member, etc.).

For example, the second and third ground patterns 135*a* may provide an extended frequency band (e.g., 38 GHz) to the dipole antenna pattern 120*a*, and may improve bandwidth or gain of an intrinsic frequency band of the dipole antenna pattern 120*a*, when the extended frequency band is similar to the intrinsic frequency band.

An antenna apparatus and an antenna module according to the examples may improve antenna performance of the dipole antenna pattern 120*a*, or allow dual-band transmission/reception of the dipole antenna pattern 120*a*.

The second ground pattern among the second and third ground patterns 135*a* may be disposed between the feed line 110*a* and the ground pattern 130*a*. The second ground pattern may further reduce a negative coupling of the ground pattern 130*a* to the feed line 110*a* or the dipole antenna pattern 120*a*.

The second ground pattern may have a greater area than the ground pattern 130*a*, such that at least a portion of the ground pattern 130*a* and at least a portion of the feed line 110*a* may overlap each other, when viewed in a vertical direction. Therefore, a negative coupling of the ground pattern 130*a* with respect to the feed line 110*a* or the dipole antenna pattern 120*a* may be further reduced.

Referring to FIG. 1A, the IC ground layer 221*a*, the ground layer 222*a*, the second ground layer 223*a*, and the wiring layer 224*a* may be recessed in a direction opposite to the dipole antenna pattern 120*a*. For example, the boundary may be closer to an inner center of the connection member 1200*a*.

A boundary of the IC ground layer 221*a*, a boundary of the ground layer 222*a*, a boundary of the second ground layer 223*a*, and a boundary of the wiring layer 224*a*, toward the dipole antenna pattern 120*a*, may act as a reflector in terms of the dipole antenna pattern 120*a*. A distance from the boundary to the dipole antenna pattern 120*a* may affect antenna performance of the dipole antenna pattern 120*a*. The dipole antenna pattern 120*a* may be spaced apart from the IC ground layer 221*a*, the ground layer 222*a*, the second ground layer 223*a*, and the wiring layer 224*a*, such that the distance is at least longer than a predetermined (certain) distance, to satisfy antenna performance, depending on a design.

As a boundary of the IC ground layer 221*a*, a boundary of the ground layer 222*a*, a boundary of the second ground layer 223*a*, and a boundary of the wiring layer 224*a* are closer to the inner center of the connection member 1200*a*, the dipole antenna pattern 120*a* may be disposed closer to the inner center of the connection member 1200*a* without substantial sacrifice of antenna performance. The antenna apparatus may be more efficiently arranged in an antenna module, such that the size of the antenna module may be relatively reduced.

Referring to FIG. 1A, the third ground layer 225*a* may cover recessed regions of the IC ground layer 221*a*, the ground layer 222*a*, the second ground layer 223*a*, and the wiring layer 224*a*, when viewed in a vertical direction. The recessed region may form a cavity. The cavity may provide a boundary condition advantageous for securing antenna performance of the dipole antenna pattern 120*a*. Since the third ground layer 225*a* may block between the antenna apparatus and a patch antenna pattern, a degree of isolation of the antenna apparatus with respect to the patch antenna pattern may be improved.

Referring to FIG. 1A, the antenna apparatus and antenna module may further include a plurality of shield vias 245*a* electrically connected to at least one of the IC ground layer 221*a*, the ground layer 222*a*, the second ground layer 223*a*, and the wiring layer 224*a*, and the shield vias 245*a* may be arranged to surround at least a portion of the recessed regions or the cavity, when viewed in a vertical direction. Since the plurality of shield vias 245*a* are disposed to block at least a portion of an interlayer gap, leaking of an RF signal into the interlayer gap may be suppressed. The plurality of shield vias 245*a* may improve antenna performance of the dipole antenna pattern 120*a*, and improve a degree of isolation between the dipole antenna pattern 120*a* and the wiring of the wiring layer 224*a*.

Referring to FIGS. 2A and 2B, the director pattern 125*a*, the second and third ground patterns 135*a*, the plurality of shield vias 245*a*, and the recessed regions may be omitted, depending on a design.

Figure 3A:
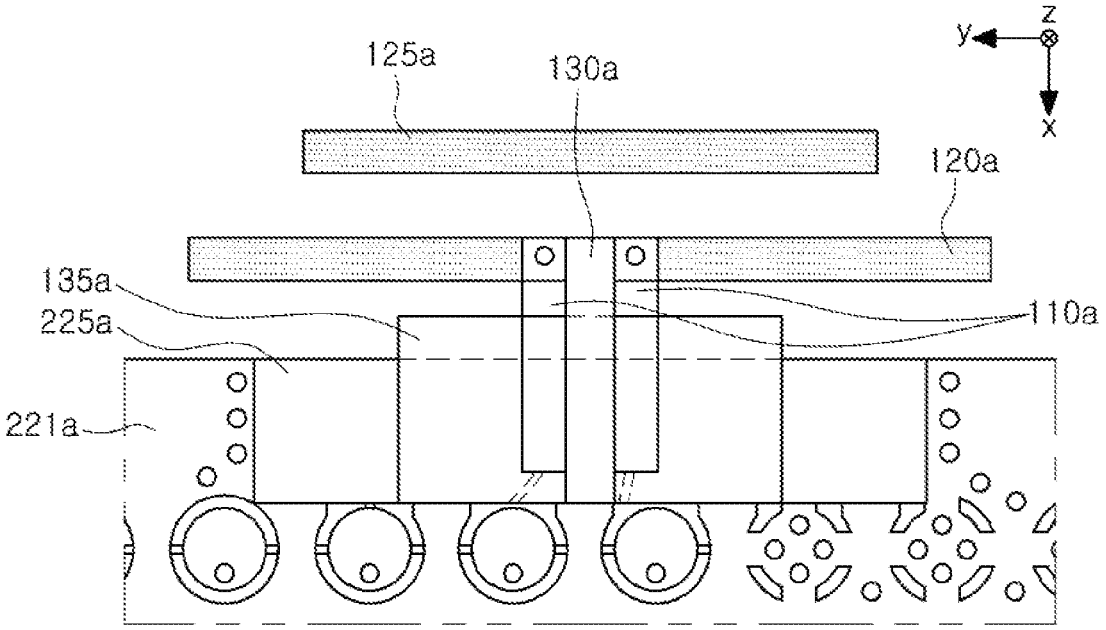
FIG. 3A is a view illustrating a lower surface of an antenna apparatus according to an example.
Figure 3B:
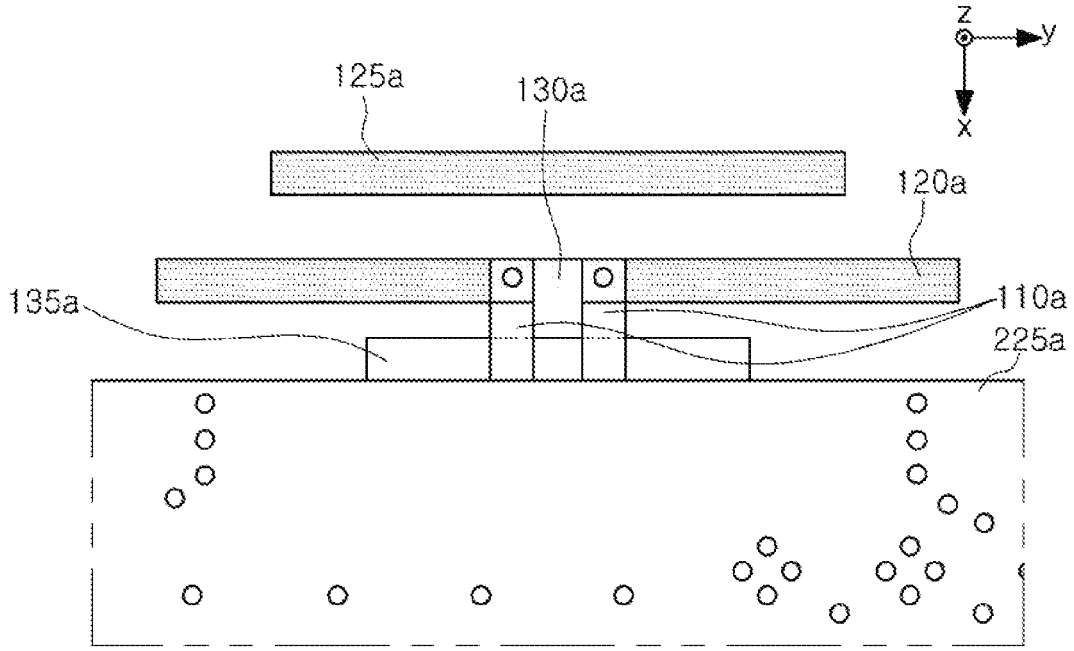
FIG. 3B is a view illustrating an upper surface of an antenna apparatus according to an example.

FIG. 3A is a view illustrating a lower surface of an antenna apparatus according to an example, and FIG. 3B is a view illustrating an upper surface of an antenna apparatus according to an example.

Referring to FIGS. 3A and 3B, second and third ground patterns 135*a* may protrude more toward a dipole antenna pattern 120*a*, than toward a third ground layer 225*a*. Therefore, a negative influence of a ground pattern 130*a* on the dipole antenna pattern 120*a* may be further reduced.

The ground pattern 130*a* may be disposed not to deviate from the feed line 110*a*, when viewed in a vertical direction, and may be disposed perpendicular to the dipole antenna pattern 120*a*. The ground pattern 130*a* may greatly reduce negative impacts, which may affect the dipole antenna pattern 120*a*, as a degree of lateral symmetry increases, and may provide a ground with the dipole antenna pattern 120*a*, while relatively reducing an influence of the dipole antenna pattern 120*a* on antenna performance.

Figure 4A:
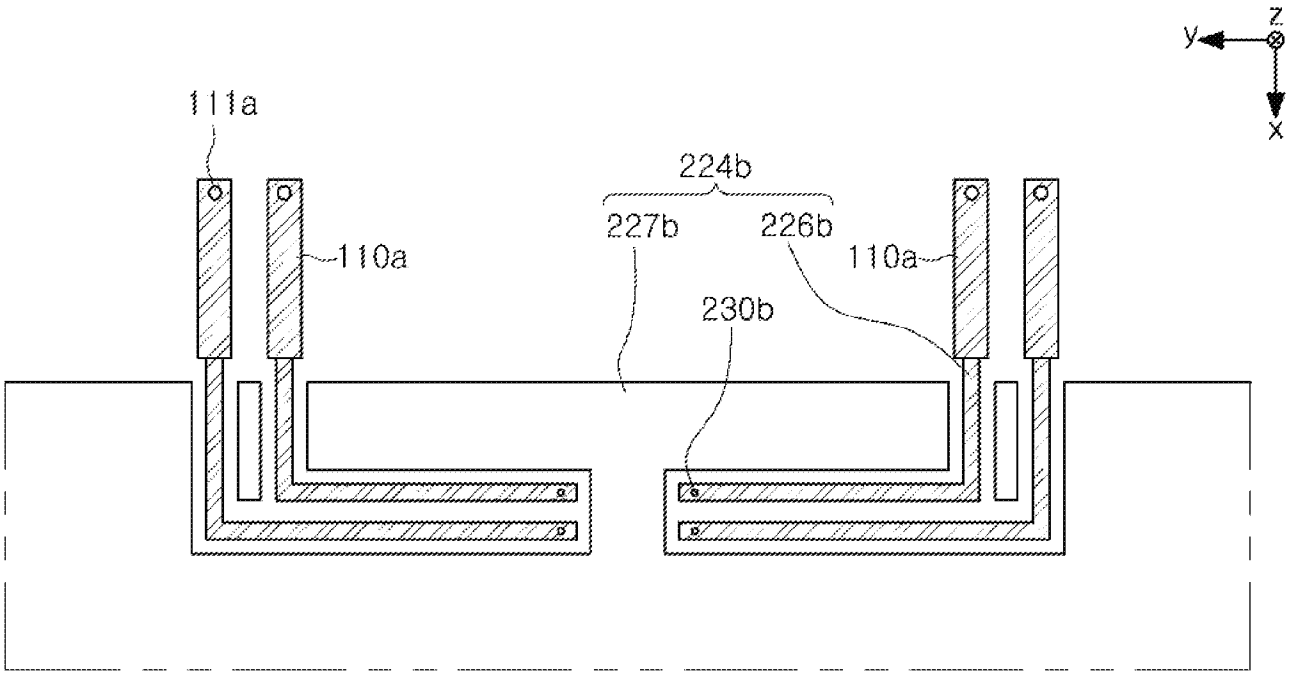
FIGS. 4A to 4C are plan views illustrating an arrangement of respective layers in an antenna apparatus and an antenna module according to an example.
Figure 4B:
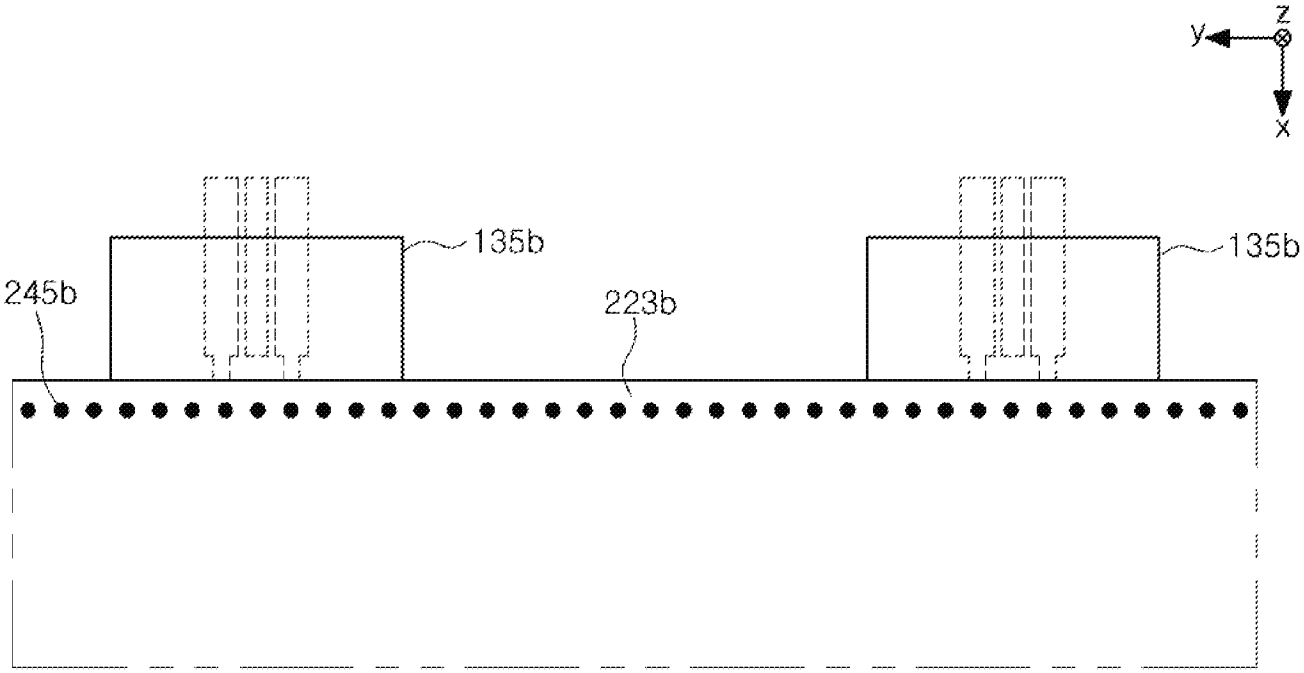
Figure 4C:
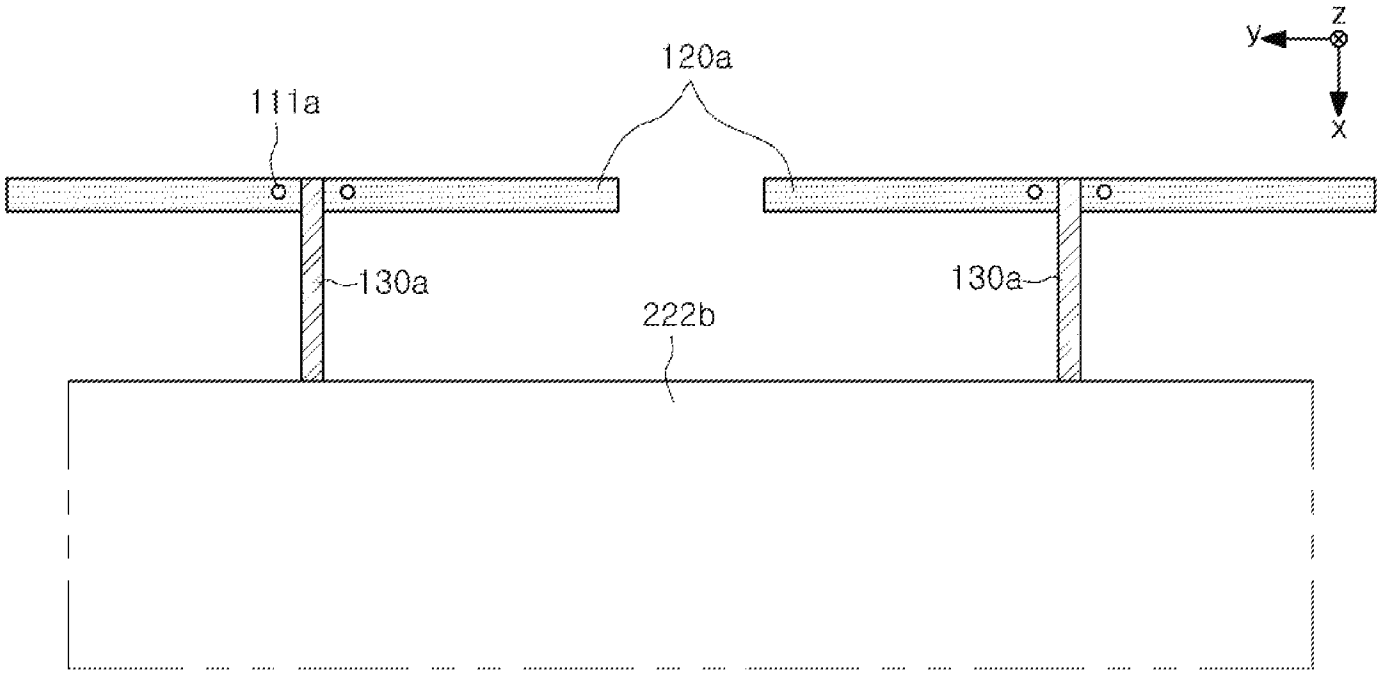

FIGS. 4A to 4C are plan views illustrating an arrangement of respective layers in an antenna apparatus and an antenna module according to an example.

Referring to FIGS. 4A to 4C, the antenna module include a plurality of antenna apparatuses corresponding to the antenna apparatuses illustrated in FIGS. 1A to 3B.

Referring to FIG. 4A, a wiring layer 224*b* may include a plurality of wiring lines 226*b* through which an RF signal flows, and a wiring ground pattern 227*b* surrounding the plurality of wiring lines 226*b*, respectively. The plurality of wiring lines 226*b* may electrically connect one end of the plurality of feed lines 110*a* to the wiring vias 230*b*. A plurality of feed vias 111*a* may be electrically connected to the other ends of the plurality of feed lines 110*a*, respectively.

Referring to FIG. 4B, a second ground layer 223*b* may be disposed in a position lower (in the z direction) than a position of the wiring layer 224*b*, and may include a plurality of shield vias 245*b* arranged adjacent to a boundary of the second ground layer 223*b*. A plurality of second ground patterns 135*b* may be connected to the second ground layer 223*b*, and may be disposed in a position lower (in the z direction) than a position of a plurality of feed lines.

Referring to FIG. 4C, a ground layer 222*b* may be disposed in a position lower (in the z direction) than a position of the second ground layer 223*b*. A plurality of dipole antenna patterns 120*a* may be electrically connected to a plurality of feed vias 111*a*, respectively. A plurality of ground patterns 130*a* may have a shape extending from a dipole center of the plurality of dipole antenna patterns 120*a* to the ground layer 222*b*, respectively.

The plurality of dipole antenna patterns 120*a* may share a ground, thereby reducing electromagnetic coupling to each other. For example, a plurality of antenna apparatuses may be spaced apart from each other by a distance shorter than a reference spacing distance (for example, 0.5 times a wavelength of an RF signal) in a case in which the plurality of ground patterns 130*a* are omitted, without deteriorating actual antenna performance. Therefore, the antenna module may increase the number of antenna apparatuses that may be arranged, relative to a unit size.

Figure 5:
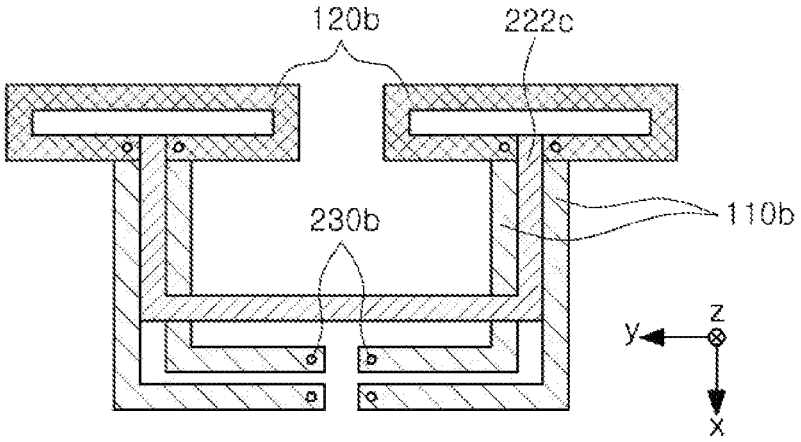
FIG. 5 is a plan view illustrating a ground pattern in an antenna apparatus and an antenna module according to an example.

FIG. 5 is a plan view illustrating a modified form of a ground pattern in an antenna apparatus and an antenna module according to an example.

Referring to FIG. 5, a ground layer 222*c* may have a shape in which a plurality of dipole antenna patterns 120*b* are electrically connected to each other by connecting respective poles of the plurality of dipole antenna patterns 120*b* to each other.

The plurality of dipole antenna patterns 120*b* may have a structure of a folded dipole, respectively.

A plurality of feed lines 110*b* may have a structure in which the plurality of wiring lines and the plurality of feed lines of the wiring layer illustrated in FIG. 4A are integrated. One end of the plurality of feed lines 110*b* may be electrically connected to a wiring via 230*b*. The wiring via 230*b* may be electrically connected to an IC.

Figure 6A:
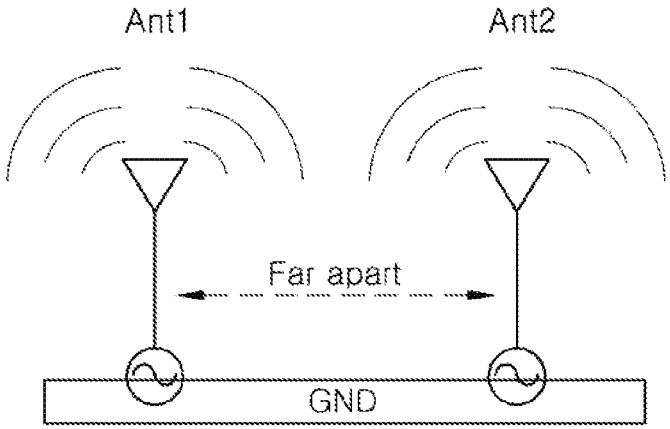
FIGS. 6A to 6C are views illustrating a degree of isolation depending on the presence or absence of a connection of ground patterns in an antenna apparatus and an antenna module according to an example.
Figure 6A:
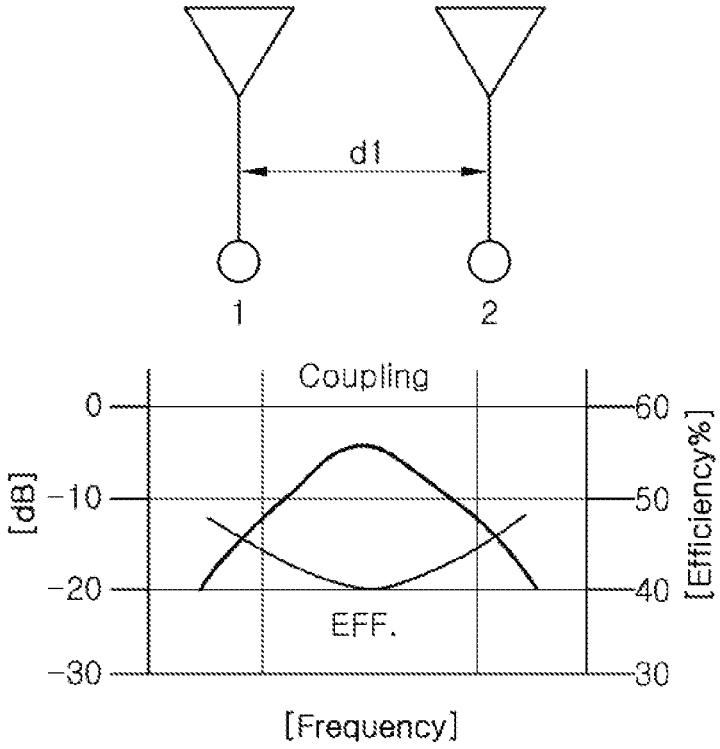
Figure 6B:
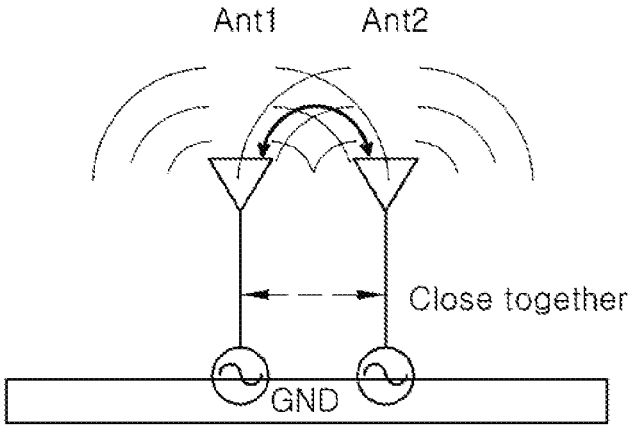
Figure 6B:
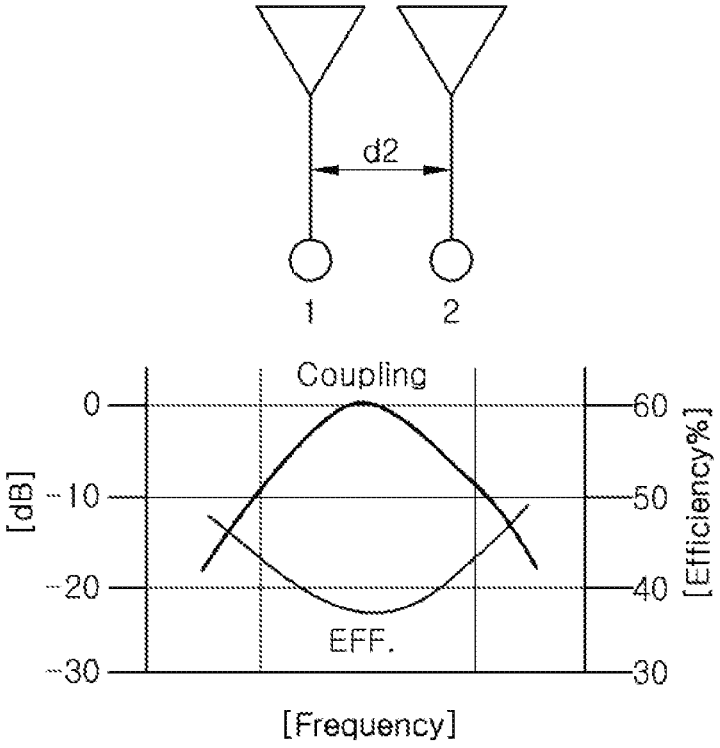
Figure 6C:
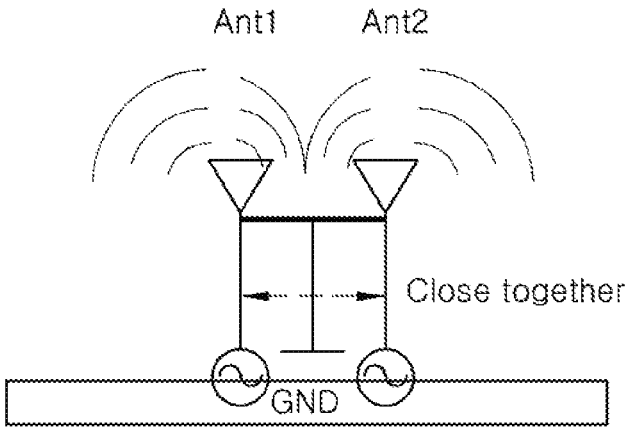
Figure 6C:
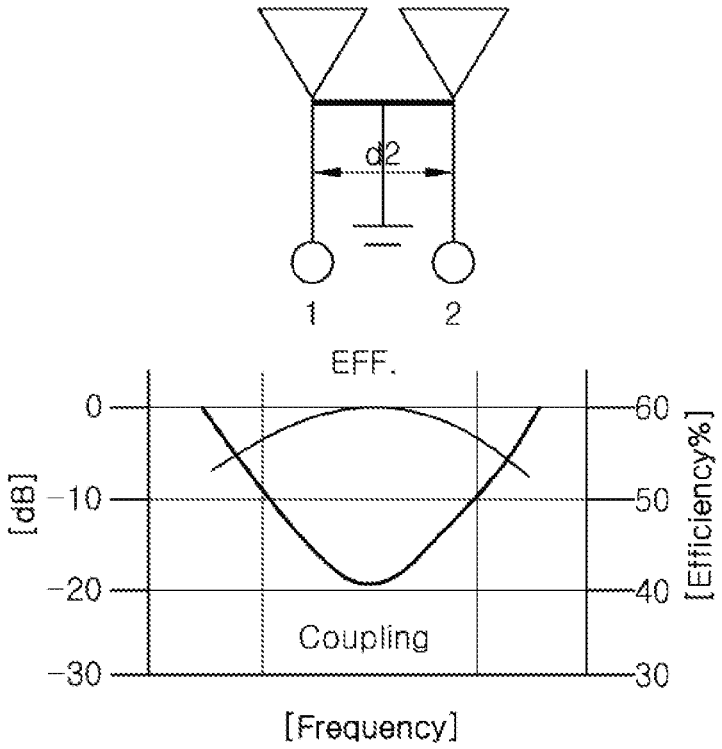

FIGS. 6A to 6C are views illustrating a degree of isolation depending on the presence or absence of a connection of ground patterns in an antenna apparatus and an antenna module according to an example.

Referring to FIG. 6A, when a distance between a first antenna apparatus Ant1 and a second antenna apparatus Ant2 is d1, electromagnetic coupling between the first antenna apparatus Ant1 and the second antenna apparatus Ant2 may be about −5 dB at the resonant frequency, and efficiency (EFF.) thereof may be about 40% at the resonant frequency. The coupling may be defined as an S parameter between the first antenna apparatus Ant1 and the second antenna apparatus Ant2.

Referring to FIG. 6B, when a distance between a first antenna apparatus Ant1 and a second antenna apparatus Ant2 is d2, which is shorter than d1, electromagnetic coupling between the first antenna apparatus Ant1 and the second antenna apparatus Ant2 may be about 0 dB at the resonant frequency, and efficiency (EFF.) thereof may be about 37% at the resonant frequency.

Referring to FIG. 6C, when a distance between a first antenna apparatus Ant1 and a second antenna apparatus Ant2 is d2, electromagnetic coupling between the first antenna apparatus Ant1 and the second antenna apparatus Ant2 may be −20 dB at the resonance frequency, and efficiency (EFF.) thereof may be about 60% at the resonance frequency.

For example, a ground pattern of an antenna apparatus and an antenna module according to an example may have an effect similar to that of a band stop filter.

The concrete numerical values of the coupling parameter and the efficiency (EFF.) Parameter illustrated in FIGS. 6A to 6C may vary according to design specifications of the antenna apparatus and antenna module.

Figure 7A:
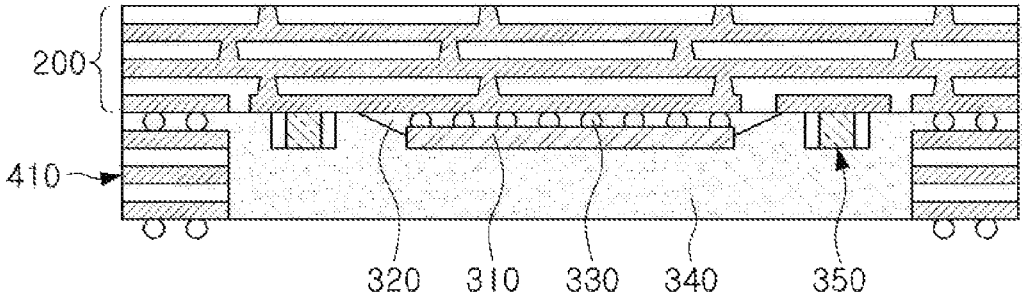
FIGS. 7A and 7B are views illustrating a lower structure of a connection member in an antenna module including an antenna apparatus according to an example.
Figure 7B:
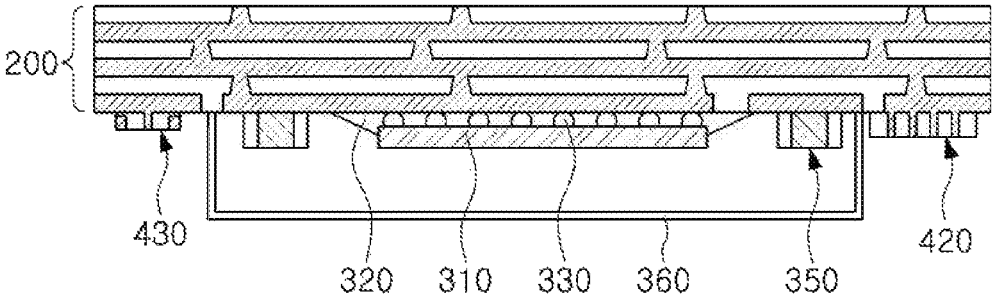

FIGS. 7A and 7B are views illustrating a lower structure of a connection member in an antenna module including an antenna apparatus according to an example.

Referring to FIG. 7A, an antenna module may include at least a portion of a connection member 200, an IC 310, an adhesive member 320, an electrical connection structure 330, an encapsulant 340, a passive component 350, and a sub-substrate 410.

The connection member 200 may have a structure similar to that of the connection member illustrated in FIGS. 1A to 2B.

The IC 310 may be the same as the IC described above, and may be disposed in a position lower than a position of the connection member 200. The IC 310 may be electrically connected to the wiring layer of the connection member 200 to transmit or receive an RF signal, and may be electrically connected to the ground layer of the connection member 200 to receive a ground. For example, the IC 310 may perform at least a portion of frequency conversion, amplification, filtering, phase control, and power generation to generate a converted signal.

The adhesive member 320 may bond the IC 310 and the connection member 200 to each other.

The electrical connection structure 330 may electrically connect the IC 310 and the connection member 200. For example, the electrical connection structure 330 may be disposed to electrically connect the wiring and the ground layer of the connection member 200, and may have a structure such as a solder ball, a pin, a land, and a pad. The electrical connection structure 330 has a melting point lower than that of the wiring and the ground layer of the connection member 200, such that the IC 310 and the connection member 200 may be electrically connected through a predetermined (certain) process using the low melting point.

The encapsulant 340 may encapsulate at least a portion of the IC 310, and may improve the heat radiation performance and the shock protection performance of the IC 310. For example, the encapsulant 340 may be implemented with a photoimageable encapsulant (PIE), Ajinomoto build-up film (ABF), epoxy molding compound (EMC), or the like.

The passive component 350 may be disposed on the lower surface of the connection member 200, and may be electrically connected to the wiring and/or ground layer of the connection member 200 through the electrical connection structure 330.

The sub-substrate 410 may be disposed in a position lower than a position of the connection member 200, and may be electrically connected to the connection member 200 to receive an intermediate frequency (IF) signal or a baseband signal from the outside and transmit the signal to the IC 310, or receive an IF signal or a baseband signal from the IC 310 and transmit the signal to the outside. A frequency of the RF signal (for example, 24 GHz, 28 GHz, 36 GHz, 39 GHz, and 60 GHz) may be higher than a frequency of the IF signal (for example, 2 GHz, 5 GHz and 10 GHz).

For example, the sub-substrate 410 may transmit an IF signal or a baseband signal to the IC 310, or may receive the signal from the IC 310 through a wiring line that may be included in the IC ground layer of the connection member 200. Since the second ground layer of the connection member 200 is disposed between the IC ground layer and the wiring layer, the IF signal or the baseband signal and the RF signal may be electrically isolated in the antenna module.

Referring to FIG. 7B, an antenna module may include at least a portion of a shield member 360, a connector 420, and a chip antenna 430.

The shield member 360 may be disposed in a position lower than a position of a connection member 200, and may be disposed to confine the IC 310 in association with the connection member 200. For example, the shield member 360 may be arranged to cover (e.g., conformal shield) the IC 310 and the passive components 350 together, or cover (e.g., compartment shield) the IC 310 and the passive components 350, respectively. For example, the shield member 360 may have a hexahedral shape with one surface open, and may have a receiving space of a hexahedron through coupling with the connection member 200. The shield member 360 may be formed of a material having high conductivity such as copper to have a relatively shallow skin depth, and may be electrically connected to the ground layer of the connection member 200. The shield member 360 may reduce the electromagnetic noise that the IC 310 and the passive component 350 may receive.

The connector 420 may have a connection structure of a cable (e.g., a coaxial cable, a flexible PCB), may be electrically connected to the IC ground layer of the connection member 200, and may serve a role similar to the sub-substrate 410 from FIG. 7A. For example, the connector 420 may be provided with an IF signal, a baseband signal, and/or power from the cable, or may provide an IF signal and/or a baseband signal to the cable.

The chip antenna 430 may transmit or receive an RF signal to assist the antenna apparatus. For example, the chip antenna 430 may include a dielectric block having a dielectric constant greater than a dielectric constant of the insulating layer, and a plurality of electrodes disposed on both surfaces of the dielectric block. One of the plurality of electrodes may be electrically connected to the wiring of the connection member 200, and another electrode may be electrically connected to the ground layer of the connection member 200.

Figure 8:
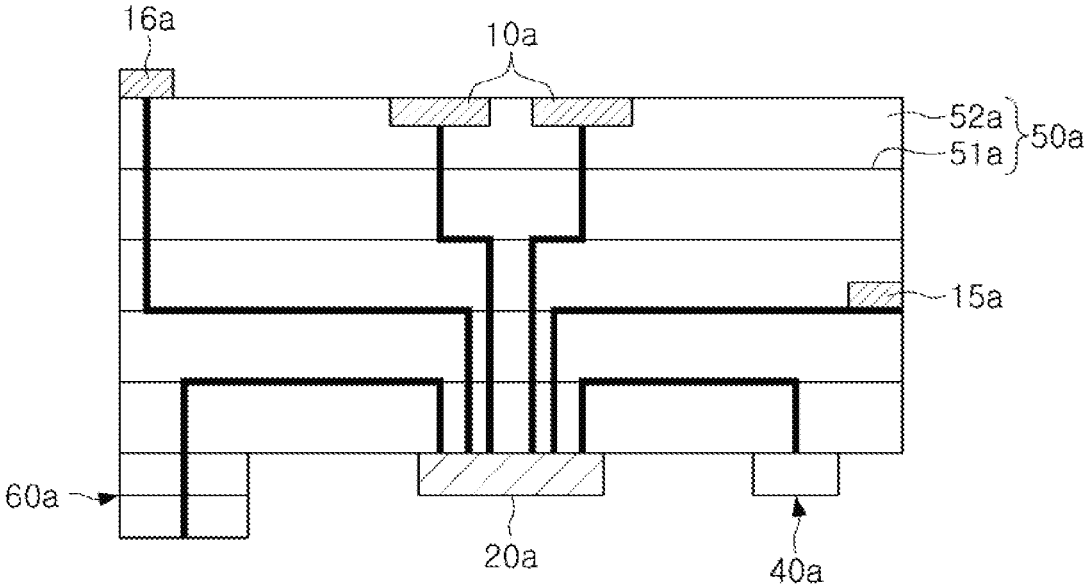
FIG. 8 is a side view illustrating a schematic structure of an antenna module including an antenna apparatus according to an example.

FIG. 8 is a side view illustrating a schematic structure of an antenna module including an antenna apparatus according to an example.

Referring to FIG. 8, an antenna module may have a structure in which a patch antenna 10*a*, a dipole antenna 15*a*, and an IC 20*a* are integrated, and include at least a portion of the patch antenna 10*a*, the dipole antenna 15*a*, a chip antenna 16*a*, the IC 20*a*, a passive component 40*a*, a substrate 50*a*, and a sub-substrate 60*a*.

The patch antenna 10*a* may be disposed adjacent to an upper surface of the substrate 50*a*, and may transmit and receive an RF signal in a normal direction of the upper surface of the substrate 50*a*. The patch antenna 10*a* may have a structure in which a patch antenna pattern and a patch antenna feed via are combined.

The dipole antenna 15*a* may correspond to an antenna apparatus according to the examples, and may be disposed adjacent to a side surface of the substrate 50*a* to transmit and receive an RF signal in a lateral direction. The antenna module may have a structure in which the patch antenna 10*a* and the dipole antenna 15*a* are integrated, such that an omnidirectional radiation pattern may be formed.

The chip antenna 16*a* may correspond to the chip antenna illustrated in FIG. 7B, and may be disposed adjacent to the upper surface or the lower surface of the substrate 50*a*.

The IC 20*a* may correspond to the IC illustrated in FIGS. 7A and 7B, and may convert an RF signal received from the patch antenna 10*a*, the dipole antenna 15*a* and/or the chip antenna 16*a* into an IF signal or a baseband signal, and the converted IF signal or the converted baseband signal may be transmitted to an IF IC, a baseband IC, or a communications modem disposed outside the antenna module. Further, the IC 20*a* may convert an IF signal or a baseband signal received from the IF IC, the baseband IC, or the communications modem disposed outside the antenna module to an RF signal, and may transmit the converted RF signal to the antenna 10*a*, the dipole antenna 15*a* and/or the chip antenna 16*a*. Depending on a design, the antenna module may further include an IF IC or a baseband IC disposed on the lower surface of the substrate 50*a*.

The passive component 40*a* may be disposed adjacent to the lower surface of the substrate 50*a*, and may correspond to the passive components illustrated in FIGS. 7A and 7B.

The substrate 50*a* may include at least one conductive layer 51*a* and at least one insulating layer 52*a*, and may include at least one via passing through an insulating layer to electrically connect a plurality of conductive layers. The at least one conductive layer 51*a* may correspond to the wiring layer and the ground layer illustrated in FIGS. 1A to 2B, and may correspond to a patch antenna pattern.

For example, the substrate 50*a* may be implemented as a printed circuit board, and may have a structure in which an upper antenna package and a lower connection member are coupled. For example, the antenna package may be designed in terms of the transmission and reception efficiency of an RF signal, and the connection member may be designed in terms of wiring efficiency.

For example, a conductive layer relatively closer to the upper surface of the substrate 50*a*, from among the at least one conductive layer 51*a*, may be used as a ground layer of the patch antenna 10*a*. A conductive layer relatively closer to the lower surface of the substrate 50*a*, from among the at least one conductive layer 51*a*, may be used as a wiring layer through which an RF signal, an IF signal, or a baseband signal passes, a ground layer for electromagnetic isolation of the wiring layer, and an IC ground layer in which the IC 20*a* is provided.

Sub-substrate 60*a* may be disposed on the lower surface of the substrate 50*a*, and may provide a path for an IF signal or a baseband signal. For example, the sub-substrate 60*a* may be mounted on the outside of the antenna module, and may be implemented as a support member to support the antenna module.

Depending on a design, the sub-substrate 60*a* may be replaced with a connector to which a coaxial cable is connected, or with a flexible insulating layer on which a signal transmission line for electrically connecting an external set substrate to the IC 20*a* is disposed.

Figure 9A:
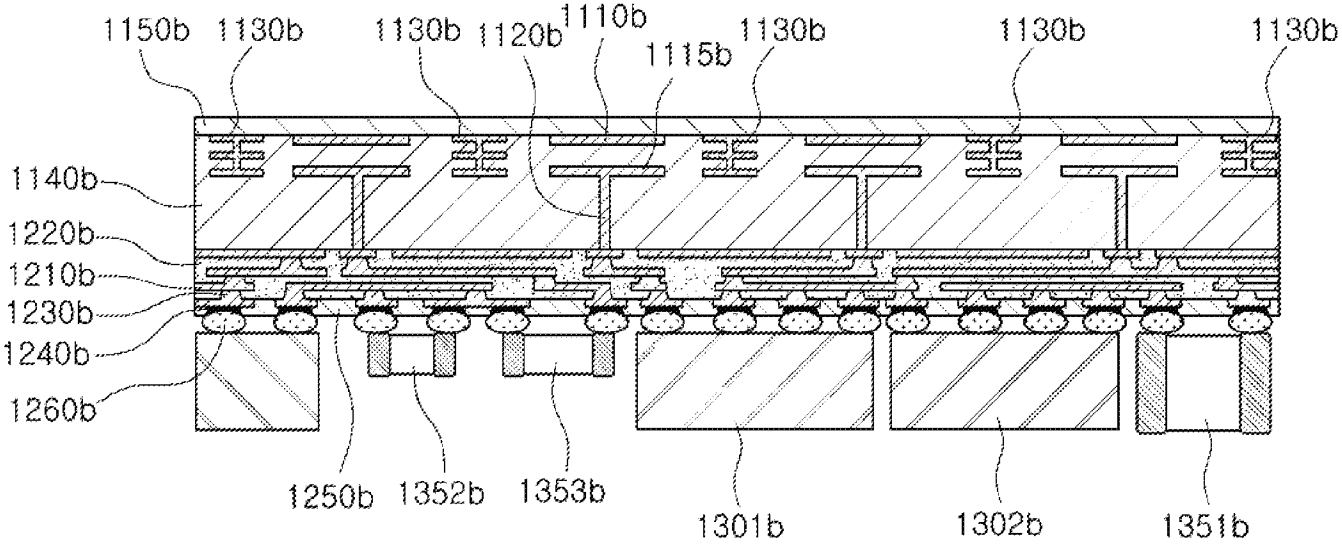
FIGS. 9A and 9B are side views illustrating various structures of an antenna module including an antenna apparatus according to an example.
Figure 9B:
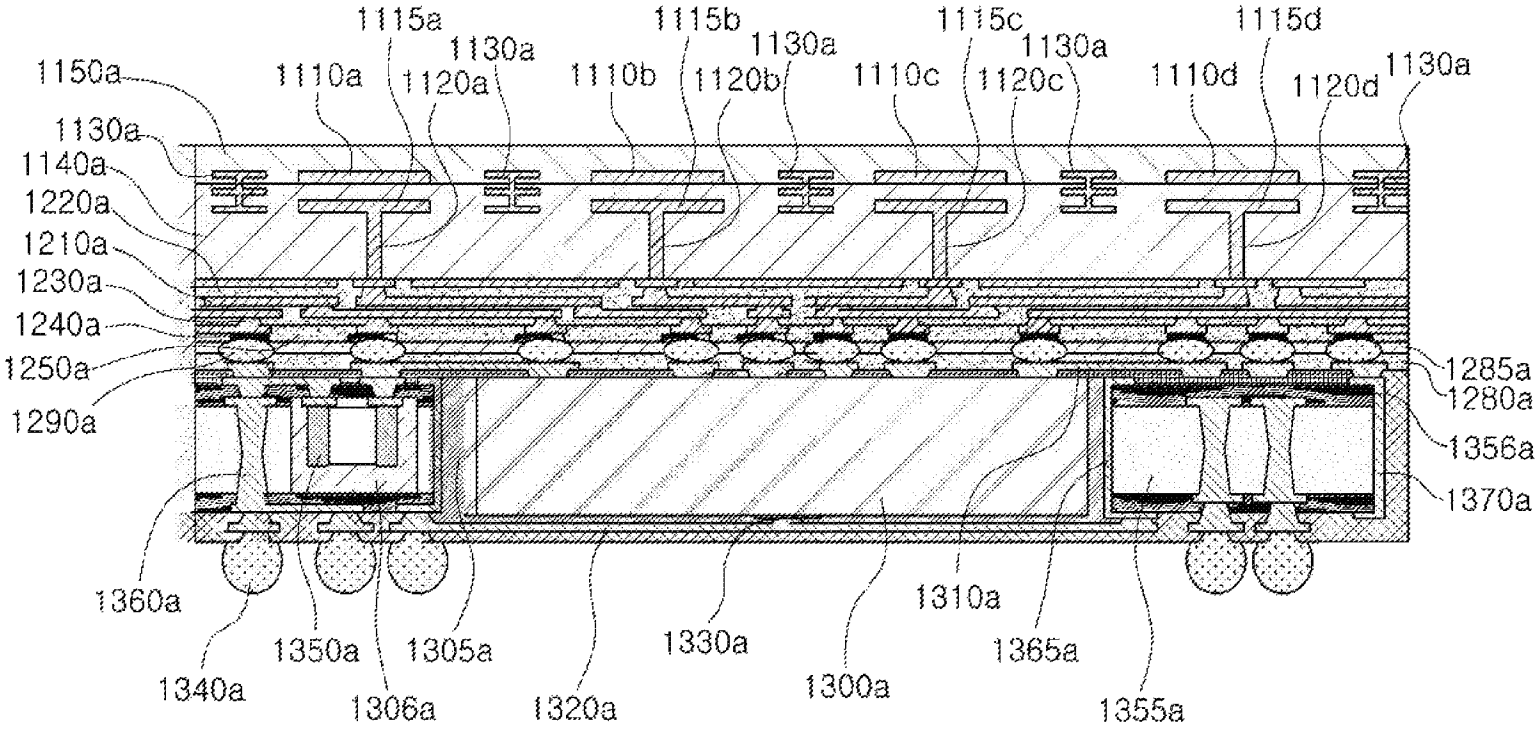

FIGS. 9A and 9B are side views illustrating various structures of an antenna module including an antenna apparatus according to an example.

Referring to FIG. 9A, an antenna module may have a structure in which an antenna package and a connection member are coupled.

The connection member may include at least one wiring layer 1210*b* and at least one insulating layer 1220*b*, may include wiring vias 1230*b* connected to the at least one wiring layer 1210*b* and a connection pad 1240*b* connected to the wiring vias 1230*b*, and may have a structure similar to a copper redistribution layer (RDL). An antenna package may be disposed on the upper surface of the connection member.

The antenna package may include at least a portion of a plurality of upper coupling members 1110*b*, a plurality of patch antenna patterns 1115*b*, a plurality of patch antenna feed vias 1120*b*, a meta member 1130*b*, a dielectric layer 1140*b*, and an encapsulation member 1150*b*, and may correspond to the patch antenna illustrated in FIG. 8.

One end of each of the plurality of patch antenna feed vias 1120*b* may be electrically connected to each of the plurality of patch antenna patterns 1115*b*, and the other ends of the plurality of patch antenna feed vias 1120*b* may be electrically connected to the corresponding wiring lines of the at least one of wiring layers 1210*b* of a connection member, respectively.

The dielectric layer 1140*b* may be arranged to surround the side surfaces of each of the plurality of feed vias 1120*b*. The dielectric layer 1140*b* may have a height greater than a height of the at least one insulating layer 1220*b* of the connection member. As a height and/or a width of the dielectric layer 1140*b* is greater, the antenna package may be advantageous in terms of securing the antenna performance, and may provide boundary conditions advantageous for RF signal transmission/reception operations of the antenna package 1115*b* (e.g., a relatively small tolerance in process, a relatively short electric length, a smooth surface, a relatively large size of dielectric layer, control of dielectric constant, etc.).

The encapsulation member 1150*b* may be disposed on the dielectric layer 1140*b*, and may improve durability to impact or oxidation of the plurality of patch antenna patterns 1115*b* and/or the plurality of upper coupling members 1110*b*. For example, the closure member 1150*b* may implemented with a photoimageable encapsulant (PIE), Ajinomoto build-up film (ABF), epoxy molding compound (EMC), or the like, but is not limited to such configurations.

An IC 1301*b*, a PMIC 1302*b* and a plurality of passive components 1351*b*, 1352*b*, and 1353*b* may be arranged on the lower surface of the connection member. The IC 1301*b* may correspond to the IC illustrated in FIG. 8.

The PMIC 1302*b* may generate a power source, and may transmit the generated power source to the IC 1301*b* through the at least one wiring layer 1210*b* of the connection member.

The plurality of passive components 1351*b*, 1352*b*, and 1353*b* may provide impedance to the IC 1301*b* and/or the PMIC 1302*b*. For example, the plurality of passive components 1351*b*, 1352*b*, and 1353*b* may include at least a portion of a capacitor (e.g., a multilayer ceramic capacitor (MLCC)), an inductor, or a chip resistor.

Referring to FIG. 9B, an IC package may include an IC 1300*a*, an encapsulant 1305*a* encapsulating at least a portion of the IC 1300*a*, a support member 1355*a* disposed such that a first side thereof faces the IC 1300*a*, and a connection member including at least one wiring layer 1310*a* and an insulation layer 1280*a* electrically connected to the IC 1300*a* and the support member 1355*a*, and may be coupled to a connection member or an antenna package.

The connection member may include at least one wiring layer 1210*a*, at least one insulating layer 1220*a*, a wiring via 1230*a*, a connection pad 1240*a*, and a passivation layer 1250*a*. The antenna package may include a plurality of upper coupling members 1110*a*, 1110*b*, 1110*c*, and 1110*d*, a plurality of antenna patterns 1115*a*, 1115*b*, 1115*c*, and 1115*d*, a plurality of feed vias 1120*a*, 1120*b*, 1120*c*, and 1120*d*, a plurality of meta members 1130*a*, a dielectric layer 1140*a*, and an encapsulation member 1150*a*.

The IC package may be coupled to the connection member. An RF signal generated by the IC 1300*a* included in the IC package may be transferred to the antenna package through the at least one wiring layer 1310*a*, and transmitted in a direction of the upper surface of the antenna module. An RF signal received from the antenna package may be transferred to the IC 1300*a* through the at least one wiring layer 1310*a*.

The IC package may further include a connection pad 1330*a* disposed on an upper surface and/or a lower surface of the IC 1300*a*. If the connection pad is disposed on the upper surface of the IC 1300*a*, it may be electrically connected to the at least one wiring layer 1310*a*, and the connection pad 1330*a* disposed on the lower surface of the IC 1300*a* may be electrically connected to the support member 1355*a* or a core plating member 1365*a* through a lower wiring layer 1320*a*. The core plating member 1365*a* may provide a ground region to the IC 1300*a*.

The support member 1355*a* may include a core dielectric layer 1356*a* contacting the connection member, a core wiring layer 1359*a* disposed on an upper surface and/or a lower surface of the core dielectric layer 1356*a*, and at least one core via 1360*a* passing through the core dielectric layer 1356*a*, electrically connecting the core wiring layer 1359*b*, and electrically connected to the connection pad 1330*a*. The at least one core via 1360*a* may be electrically connected to an electrical connection structure 1340*a* such as a solder ball, a pin, or a land.

The support member 1355*a* may receive a base signal or power source from a lower surface of the support member 1355*a*, and may transmit the base signal and/or the power source to the IC 1300*a* through the at least one wiring layer 1310*a* of the connection member.

The IC 1300*a* may generate an RF signal of a millimeter wave (mmWave) band by using the base signal and/or the power source. For example, the IC 1300*a* may receive a base signal of a low frequency, may perform frequency conversion, amplification, filtering, phase control, and power generation of the base signal, and may be implemented with a compound semiconductor (e.g., GaAs) or with a silicon semiconductor in consideration of high frequency characteristics.

The IC package may also include a passive component 1350*a* electrically connected to the corresponding wiring lines of the at least one wiring layers 1310*a*. The passive component 1350*a* may be disposed in an accommodating space 1306*a* provided by the support member 1355*a*, and may provide impedance to the IC 1300*a* and/or at least one dipole antenna pattern.

The IC package may include core plating members 1365*a* and 1370*a* disposed on the side surfaces of the support member 1355*a*. The core plating members 1365*a* and 1370*a* may provide a ground region to the IC 1300*a*, and may dissipate heat of the IC 1300*a* to the outside, or remove noise with respect to the IC 1300*a*.

The IC package and the connection member may be manufactured and coupled independently of each other, but they may be manufactured together, depending on a design. For example, a separate coupling process between a plurality of packages may be omitted.

The IC package may be coupled to the connection member via the electrical connection structure 1290*a* and the passivation layer 1285*a*, but the electrical connection structure 1290*a* and the passivation layer 1285*a* may be omitted, depending on a design.

Figure 10A:
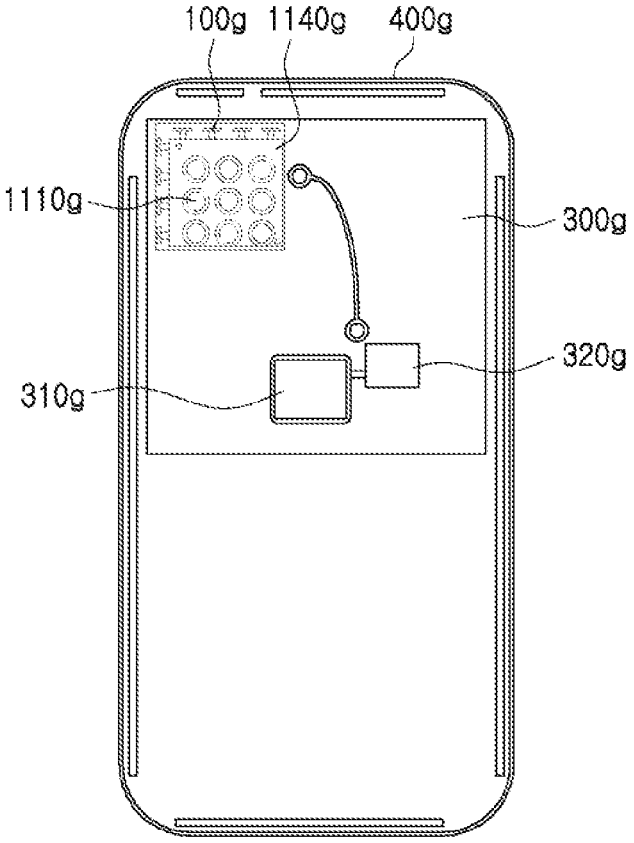
FIGS. 10A and 10B are plan views illustrating an arrangement of an antenna module in an electronic device according to an example.
Figure 10B:
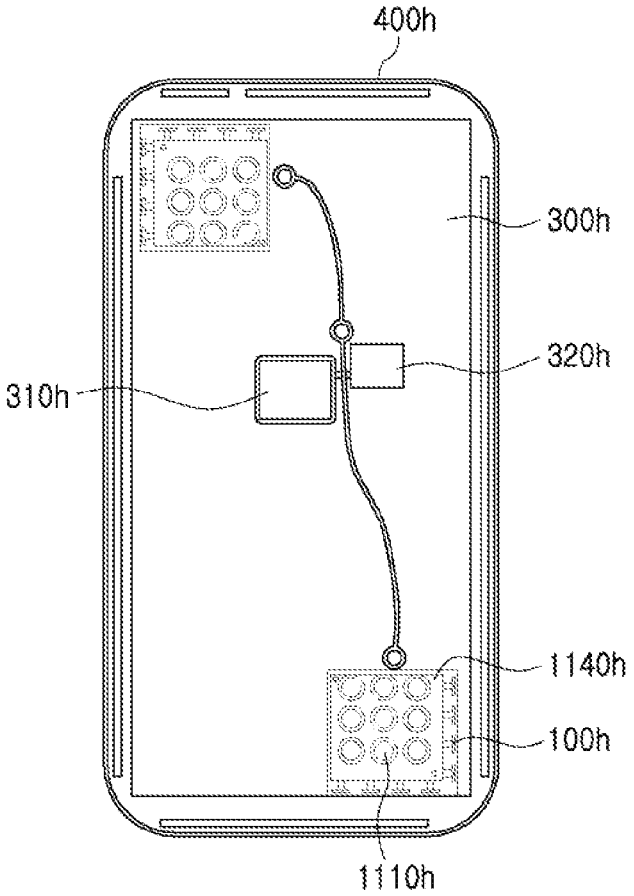

FIGS. 10A and 10B are plan views illustrating an arrangement of an antenna module in an electronic device according to an example.

Referring to FIG. 10A, an antenna module including an antenna apparatus 100*g*, a patch antenna pattern 1110*g*, and a dielectric layer 1140*g* may be disposed adjacent to a lateral boundary of an electronic device 400*g* on a set substrate 300*g* of the electronic device 400*g*.

The electronic device 400*g* may be smartphone, a personal digital assistant, a digital video camera, a digital still camera, a network system, a computer, a monitor, a tablet, a laptop, a netbook, a television, a video game, a smart watch, an automotive, or the like, but is not limited to such devices.

A communications module 310*g* and a baseband circuit 320*g* may be further disposed on the set substrate 300*g*. The communications module 310*g* may include at least a portion of a memory chip, such as a volatile memory (e.g., a DRAM), a non-volatile memory (e.g., a ROM), a flash memory, and the like; an application processor chip, such as a central processor (e.g., a CPU), a graphics processor (e.g., a GPU), a digital signal processor, a cryptographic processor, a microprocessor, a microcontroller, and the like; a logic chip, such as an analog-to-digital converter, an application-specific IC (ASIC), and the like, to perform a digital signal process.

The baseband circuit 320*g* may perform an analog-to-digital conversion, amplification in response to an analog signal, filtering, and frequency conversion to generate a base signal. The base signal input/output from the baseband circuit 320*g* may be transferred to the antenna module through a cable.

For example, the base signal may be transferred to the IC through an electrical connection structure, a core via, and a wiring. The IC may convert the base signal into an RF signal in a millimeter wave (mmWave) band.

Referring to FIG. 10B, a plurality of antenna modules each including an antenna apparatus 100*h*, a patch antenna pattern 1110*h*, and a dielectric layer 1140*h* may be disposed adjacent to a boundary of one side surface and a boundary of the other side surface of an electronic device 400*h* on a set substrate 300*h* of the electronic device 400*h*, and a communications module 310*h* and a baseband circuit 320*h* may be further disposed on the set substrate 300*h*.

The conductive layer, the wiring layer, the ground layer, the feed line, the feed via, the dipole antenna pattern, the patch antenna pattern, the ground pattern, the shield via, the director pattern, and the electrical connection structure disclosed in the examples may include a metallic material (e.g., a conductive material, such as copper (Cu), aluminum (Al), silver (Ag), tin (Sn), gold (Au), nickel (Ni), lead (Pb), titanium (Ti), alloys thereof, or the like), and may be formed according to plating methods such as a chemical vapor deposition (CVD) process, a physical vapor deposition (PVD) process, a sputtering process, a subtractive process, an additive process, a semi-additive process (SAP), a modified semi-additive process (MSAP), and the like, but is not limited to such materials and methods.

The dielectric layer and/or the insulating layer may be implemented with a thermosetting resin such as FR4, liquid crystal polymer (LCP), low temperature co-fired ceramic (LTCC), epoxy resin, or a thermoplastic resin such as polyimide, or a resin impregnated into core materials such as glass fiber, glass cloth and glass fabric together with inorganic filler, prepregs, Ajinomoto build-up film (ABF), FR-4, bismaleimide triazine (BT), photoimageable dielectric (PID) resin, a copper clad laminate (CCL), a glass or ceramic based insulating material, or the like. The insulating layer may be filled in at least a portion of a position on which a conductive layer, a wiring layer, a ground layer, a feed line, a feed via, a dipole antenna pattern, a patch antenna pattern, a ground pattern, a shield via, a director pattern, and an electrical connection structure are not disposed, in the antenna apparatus and the antenna module.

The RF signals may have a format according to Wi-Fi (IEEE 802.11 family), WiMAX (IEEE 802.16 family), IEEE 802.20, long term evolution (LTE), Ev-DO, HSPA+, HSDPA+, HSUPA+, EDGE, GSM, GPS, GPRS, CDMA, TDMA, DECT, Bluetooth, 3G, 4G, 5G, and any other wireless and wired protocols designated later thereto, but are not limited to such formats.

The antenna apparatus has a structure that may reduce the influence on other neighboring antenna apparatuses, such that a spacing distance to other neighboring antenna apparatuses may be relatively reduced. Since the antenna module may reduce the size of the antenna apparatus in unit size or increase the number of antenna apparatuses compared to the unit size, antenna performance (e.g., transmission/reception ratio, gain, bandwidth, directivity, and the like), or may have a structure favorable to downsizing.

The antenna apparatus may reduce the design limit due to the influence of other antenna apparatuses when designing the antenna apparatus, such that it may have an improved degree of design freedom and may improve the antenna performance may be improved.

The antenna apparatus and the antenna module may reduce a negative coupling to the dipole antenna pattern of the ground pattern while improving the degree of isolation between the plurality of antenna apparatuses according to the ground pattern, or the size of the antenna module may be further reduced.

The communication modules 310*g* and 310*h* in FIGS. 10A and 10B, for example, that perform the operations described in this application are implemented by hardware components configured to perform the operations described in this application that are performed by the hardware components. Examples of hardware components that may be used to perform the operations described in this application where appropriate include controllers, sensors, generators, drivers, memories, comparators, arithmetic logic units, adders, subtractors, multipliers, dividers, integrators, and any other electronic components configured to perform the operations described in this application. In other examples, one or more of the hardware components that perform the operations described in this application are implemented by computing hardware, for example, by one or more processors or computers. A processor or computer may be implemented by one or more processing elements, such as an array of logic gates, a controller and an arithmetic logic unit, a digital signal processor, a microcomputer, a programmable logic controller, a field-programmable gate array, a programmable logic array, a microprocessor, or any other device or combination of devices that is configured to respond to and execute instructions in a defined manner to achieve a desired result. In one example, a processor or computer includes, or is connected to, one or more memories storing instructions or software that are executed by the processor or computer. Hardware components implemented by a processor or computer may execute instructions or software, such as an operating system (OS) and one or more software applications that run on the OS, to perform the operations described in this application. The hardware components may also access, manipulate, process, create, and store data in response to execution of the instructions or software. For simplicity, the singular term "processor" or "computer" may be used in the description of the examples described in this application, but in other examples multiple processors or computers may be used, or a processor or computer may include multiple processing elements, or multiple types of processing elements, or both. For example, a single hardware component or two or more hardware components may be implemented by a single processor, or two or more processors, or a processor and a controller. One or more hardware components may be implemented by one or more processors, or a processor and a controller, and one or more other hardware components may be implemented by one or more other processors, or another processor and another controller. One or more processors, or a processor and a controller, may implement a single hardware component, or two or more hardware components. A hardware component may have any one or more of different processing configurations, examples of which include a single processor, independent processors, parallel processors, single-instruction single-data (SISD) multiprocessing, single-instruction multiple-data (SIMD) multiprocessing, multiple-instruction single-data (MISD) multiprocessing, and multiple-instruction multiple-data (MIMD) multiprocessing.

The instructions or software to control computing hardware, for example, one or more processors or computers, to implement the hardware components and perform the methods as described above, and any associated data, data files, and data structures, may be recorded, stored, or fixed in or on one or more non-transitory computer-readable storage media. Examples of a non-transitory computer-readable storage medium include read-only memory (ROM), random-access memory (RAM), flash memory, CD-ROMs, CD-Rs, CD+Rs, CD-RWs, CD+RWs, DVD-ROMs, DVD-Rs, DVD+Rs, DVD-RWs, DVD+RWs, DVD-RAMs, BD-ROMs, BD-Rs, BD-R LTHs, BD-REs, magnetic tapes, floppy disks, magneto-optical data storage devices, optical data storage devices, hard disks, solid-state disks, and any other device that is configured to store the instructions or software and any associated data, data files, and data structures in a non-transitory manner and provide the instructions or software and any associated data, data files, and data structures to one or more processors or computers so that the one or more processors or computers can execute the instructions. In one example, the instructions or software and any associated data, data files, and data structures are distributed over network-coupled computer systems so that the instructions and software and any associated data, data files, and data structures are stored, accessed, and executed in a distributed fashion by the one or more processors or computers.

While this disclosure includes specific examples, it will be apparent after an understanding of the disclosure of this application that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. An antenna apparatus comprising:

a ground layer;

a wiring layer spaced apart from either a first surface or a second surface of the ground layer and comprising wiring lines;

feed lines electrically connected to the wiring lines;

a dipole antenna pattern configured to transmit and/or receive an RF signal;

feed vias configured to electrically connect poles of the dipole antenna pattern to the feed lines; and a ground pattern configured to electrically connect the poles of the dipole antenna pattern to the ground layer.

2. The antenna apparatus according to claim 1, wherein the ground pattern extends from the ground layer to an area between the poles of the dipole antenna pattern and overlaps a space between two of the feed lines.

3. The antenna apparatus according to claim 2, wherein feed vias extend in a thickness direction of the antenna apparatus, the dipole antenna pattern extends in a first direction perpendicular to the thickness direction, and the feed lines and the ground pattern extend in a second direction perpendicular to the thickness direction and perpendicular to the first direction.

4. The antenna apparatus according to claim 3, further comprising a director pattern coplanar with the dipole antenna pattern and spaced apart from the dipole antenna pattern in the second direction.

5. The antenna apparatus according to claim 1, further comprising:

a second ground layer disposed between the ground layer and the wiring layer; and a second ground pattern electrically connected to the second ground layer and disposed between the feed lines and the ground pattern.

6. The antenna apparatus according to claim 5, wherein the second ground pattern has a larger area than the ground pattern and overlaps at least a portion of the ground pattern and at least a portion of each of the feed lines in a direction perpendicular to a thickness direction of the antenna apparatus.

7. The antenna apparatus according to claim 5, further comprising:

a third ground layer; and a third ground pattern electrically connected to the third ground layer, wherein the wiring layer is disposed between the second ground layer and the third ground layer, and wherein the feed lines are disposed between the second ground pattern and the third ground pattern.

8. The antenna apparatus according to claim 7, wherein the wiring layer, the ground layer, and the second ground layer comprise recessed regions in a direction opposite to a direction in which the dipole antenna pattern is spaced apart from the ground layer, and wherein the third ground layer overlaps the recessed regions of the wiring layer, the ground layer, and the second ground layer in a direction perpendicular to a thickness direction of the antenna apparatus.

9. The antenna apparatus according to claim 8, further comprising shield vias electrically connected to one or both of the ground layer and the second ground layer, and surrounding at least a portion of the recessed regions of the wiring layer, the ground layer, and the second ground layer in the direction perpendicular to the thickness direction.

10. An apparatus comprising:

an antenna comprising:

a dipole antenna pattern configured to transmit and/or receive an RF signal;

a ground layer;

a ground pattern extending from the ground layer to a dipole center of the dipole antenna pattern;

a wiring layer spaced apart from the ground layer and comprising wiring lines; and feed lines extending from the wiring layer such that the ground pattern overlaps a space between the feed lines.

11. The apparatus of claim 10, further comprising a substrate, wherein the antenna and the patch antenna pattern are disposed adjacent to a lateral boundary on the substrate.

12. The apparatus of claim 11, further comprising a communication module connected to the antenna.

13. The apparatus of claim 10, further comprising a patch antenna pattern.

* * * * *